United States Patent [19]

Cassidy

[11] Patent Number: 5,029,714

[45] Date of Patent: Jul. 9, 1991

[54] EASILY OPENABLE PAPERBOARD CARTON FOR FOODSTUFFS

[75] Inventor: Benjamin J. Cassidy, Waldwick, N.J.

[73] Assignee: International Paper Company, Purchase, N.Y.

[21] Appl. No.: 506,145

[22] Filed: Apr. 9, 1990

[51] Int. Cl.[5] ..... B65D 5/54

[52] U.S. Cl. ..... 206/631; 206/626; 229/134

[58] Field of Search ..... 206/624, 625, 626, 631, 206/631.1, 631.2; 229/132, 134, 154

[56] References Cited

U.S. PATENT DOCUMENTS

| | | | |
|---|---|---|---|
| 1,776,923 | 9/1930 | Nemoede | 206/631 |
| 2,114,134 | 4/1938 | Weiss | 206/631 |
| 2,154,475 | 4/1939 | Shearer | 206/631 |
| 2,259,822 | 10/1941 | Kienlen | 206/631 |
| 2,828,060 | 3/1958 | Brown | 206/624 |
| 2,844,297 | 7/1958 | Holmes | 206/631 |
| 3,015,432 | 1/1962 | Tyrseck | 206/631 |
| 3,096,918 | 7/1963 | Van Dyke et al. | 206/631 |
| 3,423,005 | 1/1969 | Leibson et al. | 206/631 |
| 3,491,937 | 1/1970 | Brastad | 206/631 |
| 4,250,994 | 2/1981 | Focke | 229/134 |

*Primary Examiner*—Gary E. Elkins

*Attorney, Agent, or Firm*—Michael J. Doyle; Walt Thomas Zielinski

[57] ABSTRACT

A paperboard carton formed from a unitary blank of paperboard. A side flap of the carton bottom is overlapped with and sealed to a side flap of the top cover. At least one of these flaps is provided with spaced abseal (adhesion resistant) areas. The interabseal areas are provided with adhesive to seal against the other, overlapping flap. The interabseal areas are bordered by cut lines extending partially through the paperboard, and are preferably embossed so as to be raised from the remaining flap area. The other front and side flaps are conventionally sealed together by an adhesive, such as a heat activated PET coating on the paperboard surface. To effect opening, these two flaps are pulled apart with the adhered together, interabseal are a of one of these flaps delaminating by virtue of the cut lines, the latter extending completely through the PET coating.

6 Claims, 2 Drawing Sheets

EASILY OPENABLE PAPERBOARD CARTON FOR FOODSTUFFS

BACKGROUND OF THE INVENTION

This invention relates to containers and more particularly to a carton formed from a unitary blank of paperboard and particularly adapted to package a foodstuff. The blank is cut, provided with fold lines and is assembled by bending the panels about the fold lines and adhering the side and front panels or flaps together.

The art is aware of a great variety of paperboard cartons which are generally rectangular (termed a parallelepiped) having a bottom panel with upstanding side and edge panels and a hinged top cover panel having a front flap and two oppositely disposed end flaps. Often, paperboard cartons are closed by the application of adhesive along portions of overlapping panels such as the front bottom panel and front cover flap. While suitable for many uses, such prior constructions are not easily openable, particularly those constructions which are intended for the packaging of foodstuffs, such as microwavable frozen foods, which require a more secure seal than other products. If the package is securely sealed along all of its side and front panels, it is usually difficult to open without the use of special and relatively expensive opening arrangements such as tear strips.

SUMMARY OF THE INVENTION

According to the practice of this invention, a paperboard carton formed from a unitary blank of paperboard, typically coated on both sides with polyethleneterephthelate (PET) is provided with a novel and useful opening feature. One side panel or flap of the top cover is provided near its free edge with a plurality of spaced apart abseal areas, generally rectangular, with each of these abseal areas being bounded on either side by cut lines. The cut lines extend from the interior surface completely through the PET coating and approximately one half through the paperboard. Those spaces between the abseal areas are embossed and are defined by these same cut lines, and additionally by a similar cut line. One side panel of the carton bottom, which is overlapped by one side panel or flap of the top cover is also provided with spaced abseal areas and embossed portions. Corresponding embossed portions are adhered together by any conventional adhesives such as PET coating when heated. To effect carton opening, the top cover side panel carrying the abseal areas is pulled from its respective carton bottom side panel. The embossed portions delaminate, with the ripping being facilitated by the cut lines. The top cover end panel separates from its corresponding end panel to provide a side opening in the carton.

DETAILED DESCRIPTION OF THE INVENTION

Figure 1:
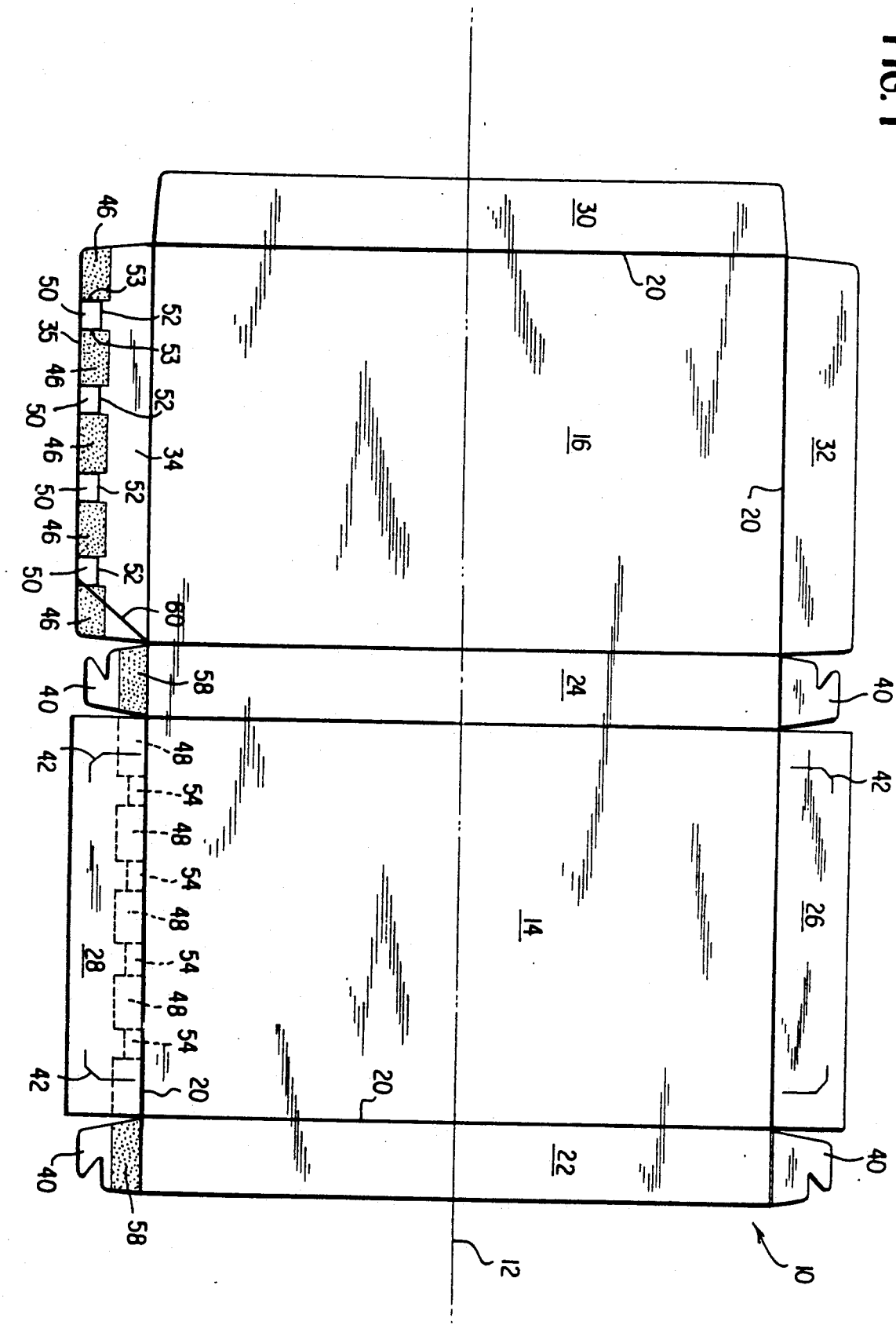
FIG. 1 a plan view of a unitary blank of plastic coated paperboard, cut and scored to be folded and erected into the carton of this invention.

Referring now to FIG. 1 of the drawings, the numeral 10 denotes generally the blank from which the carton of this invention is fashioned, the blank having a longitudinal axis 12. The carton bottom panel is denoted as 14 while the numeral 16 denotes the top cover panel. The fold lines 20 separate the blank into the various panels which have been and will now be described. Bottom front panel 22 is secured to the right portion of bottom panel 14, with the rear bottom panel denoted as 24, the latter foldably secured to top the cover panel 16. Bottom end panels 26 and 28 are foldably secured to bottom panel 14, with top cover panel having a front side panel 30 and opposite end panels 32 and 34. The lower free edge of panel 34 is denoted as 35.

Figures 2, 3:
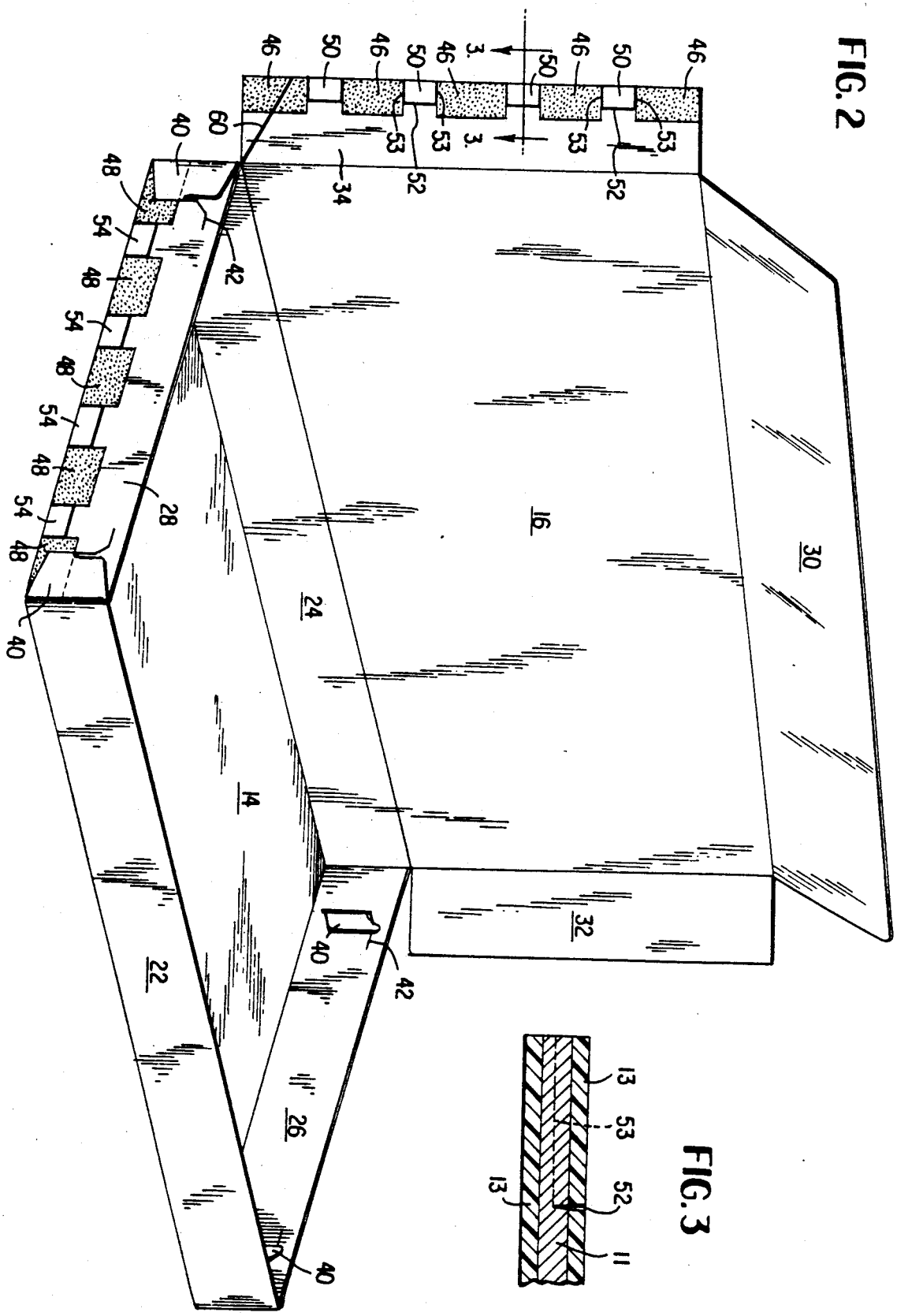
FIG. 2 is a view showing the blank erected and assembled in an open position, prior to closing and sealing.
FIG. 3 is a view taken along section 3—3 of FIG. 2.

A plurality of generally rectangular abseal areas 46 are provided along side panel 34, bordering on its free edge 35. A plurality of embossed areas 50 extend between abseal areas 46, with a plurality of cut lines 52 and 53. These cut lines border and define, with the free edge 35, a plurality of rectangular areas extending between rectangular abseal areas 46. Embossments 50 extend out of the plane of FIG. 1, toward the reader. Cut lines 52 and 53, as shown at FIG. 3, extend through the PET coating on the inside surface (facing the reader) of the blank, with the cuts extending to approximately half the thickness of paperboard 11. As indicated at FIG. 3, both surfaces of the paperboard blank are provided with PET or other thermoplastic coating.

Locking tongue elements 40, secured to the ends of bottom front and rear panels 22 and 24, are adapted to engage slits 42, two of which are provided at each end panel 26 and 28. The tongue and slits are used to erect the carton from the blank.

Bottom end panel 28 is provided with a plurality of spaced abseal areas 48 located nearest that fold line 20 which joins bottom panel 14 to bottom end panel 28. A plurality of rectangular embossed regions 54 are located between rectangular abseal areas 48. Areas 54 and 50 are termed interabseal areas, since they are located between abseal areas 48 and 46, respectively. Abseal areas 48 and embossed areas 54 of panel 28 are on the other side of the blank, being that side which faces away from the viewer in FIG. 1. This is the distinction to abseal areas 46 and embossed areas 50 of panel 34 which are on that surface of the blank which faces the reader. The manner of illustrating areas 48 and 54 at FIG. 1 is used for purposes of explanation and clarity. An angle score line 60 extends from free edge 35 of top cover panel 34 to the lower right corner of top cover panel 16. This angle score line is to facilitate opening of the carton.

Referring now to FIG. 2 of the drawings, the carton is shown as having been erected and ready for filling and closing. The reader will observe that abseal areas 46 and embossed areas 50 of panel 34 are adapted to oppositely overlie and mate with corresponding abseal areas 48 and embossed areas 54 of panel 28 when the carton is closed by folding top cover panel 16 clockwise from the indicated configuration. Embossed areas 50 extend, in FIG. 2, towards the reader, as they do in FIG. 1. Embossed areas 54 of end panel 28 extend outward from the illustrated surface of panel 28 at FIG. 2, towards the left.

To seal panels 28 and 34 together, the PET coatings on embossed areas 50 and 54 may be activated by heat and pressure, as is conventional. Alternatively, an adhesive is applied to one or both of these areas.

To effect opening of the carton, the user grasps the lower left end corner of panel 34, as viewed at FIG. 2, and causes it to bend outwardly along fold line 60 to form a pull tab. Then, pulling results in a ripping away of the end panel 34 from end panel 28 by virtue of the paperboard tearing along cut lines 52, and 53. The ripping action is such that embossed areas 50 delaminate from panel 34 along cut lines 52 and 53 which surround each area 50. The user then removes the carton contents by pulling panel 28, rotating it about its fold line 20, causing the tongues 40 therein to pull out of their respective slits 42.

The remaining flap pairs 22, 30 and 32, 26 may be secured together in overlapping, sealed relation in any conventional manner. Similarly, the manner of forming abseal (abhesive) areas 46 and 48 (to prevent their adhesing together, i.e. the opposite of adhesive) and the method of forming embossed areas 50 and 54 may be carried out in any known manner.

It will be apparent that the front flaps or panels of the carton may be provided with the abseal and embossed areas instead of one of the pairs of side flaps.

Terms of geometrical orientation such as upper, lower, slanted, and the like are employed to assist the reader to an understanding, and are not intended as terms of limitation.

I claim:

1. An easily openable carton formed from a unitary blank of paperboard, the carton having a generally rectangular bottom panel with upstanding front and rear side panels and two end panels, the rear side panel being foldably secured to a generally rectangular top cover panel, the top cover panel being of substantially the same size and shape as the bottom panel, the top cover panel having a front side panel and two end panels, the top cover front side panel overlapping the bottom panel front side panel and the top cover end panels overlapping the bottom panel end panels, the interior surface of a first end panel provided with a plurality of spaced apart abseal areas along its length, the paperboard between said spaced apart abseal areas each having cut lines extending partially through the thickness of said paperboard and bordering the abseal areas, interabseal areas of said first end panel between the abseal areas being bordered by said cut lines and sealed to, corresponding, facing areas of a respective second end panel overlapping said first end panel with the abseal areas thereon and the second, overlapping end panel being sealed together at said interabseal areas, said panels having surfaces, whereby said panels can be ripped apart by delamination of the paperboard facilitated by the cut lines at the interabseal areas, said interabseal areas on said first end panel being embossed.

2. A unitary paperboard blank for forming an easily openable carton, the blank having a generally rectangular bottom panel with front and rear side panels and two end panels, the rear side panel being foldably secured to a generally rectangular top cover panel, a top cover panel of substantially the same size and shape as the bottom panel, the top cover panel having a front side panel and two end panels, the interior forming surface of a first end panel provided with a plurality of spaced apart abseal areas along its length, interabseal areas of the paperboard betwen said spaced apart abseal areas each having cut lines extending partially through the thickness of said paperboard and connecting the abseal areas, said interabseal areas being embossed.

3. The blank of claim 2 wherein said embossed areas are each bounded by an edge of said first end panel, a cut line, and two adjacent abseal areas.

4. The blank of claim 2 including abseal areas on said second end panel, the abseal areas of said first and second end panels being in opposite, facing relationship.

5. An easily openable carton formed from a unitary blank of paperboard, the carton having a generally rectangular bottom panel with upstanding front and rear side panels and two end panels, the rear side panel being foldably secured to a generally rectangular top cover panel, the top cover panel being of substantially the same size and shape as the bottom panel, the top cover panel having a front side panel overlapping the bottom panel front side panel and the top cover end panels overlapping the bottom panel and panels, the interior surface of a first end panel provided with a plurality of spaced apart abseal areas along its length, the paperboard between said spaced apart abseal areas each having cut lines extending partially through the thickness of said paperboard and bordering the abseal areas, interabseal areas of said first end panel between the abseal areas being bordered by said cut lines and sealed to corresponding, facing areas of a respective second end panel overlapping said first end panel with the abseal areas thereon and the second, overlapping end panel being sealed together at said interabseal areas, said panels having surfaces, whereby said panels can be ripped apart by delamination of the paperboard facilitated by the cut lines at the abseal areas on said second end panel, the abseal areas of said first and second end panels being in opposite, facing relationship.

6. An easily openable carton formed from a unitary blank of paperboard, the carton having a generally rectangular bottom panel with upstanding front and rear side panels and two end panels, the rear side panel being foldably secured to a generally rectangular top cover panel, the top cover panel being of substantially the same size and shape as the bottom panel, the top cover panel having a front side panel and two end panels, the top cover front side panel overlapping the bottom panel front side panel and the top cover end panels overlapping the bottom panel end panels, the interior surface of a first end panel provided with a plurality of spaced apart abseal areas along its length, the paperboard between said spaced apart abseal areas each having cut lines extending partially through the thickness of said paperboard and bordering the abseal areas, interabseal areas of said first end panel between the abseal areas being bordered by said cut lines and sealed to, corresponding, facing areas of a respective second end panel overlapping said first end panel with the abseal areas thereon and the second, overlapping end panel being sealed together at said interabseal areas, said panels having surfaces, whereby said panels can be ripped apart by delamination of the paperboard facilitated by the cut lines at the interabseal areas, the surfaes of said panels being coated with a plastic film and wherein said cuts extend through one of said films.

* * * * *